US006597102B2

(12) United States Patent
Sugawara et al.

(10) Patent No.: US 6,597,102 B2
(45) Date of Patent: Jul. 22, 2003

(54) GLASS BULB FOR A CATHODE RAY TUBE AND CATHODE RAY TUBE

(75) Inventors: Tsunehiko Sugawara, Chiba (JP); Mikio Miyamoto, Chiba (JP); Toshihiro Ohashi, Chiba (JP); Takahiro Murakami, Chiba (JP)

(73) Assignee: Asahi Glass Company, Limited, Tokyo (JP)

( * ) Notice: Subject to any disclaimer, the term of this patent is extended or adjusted under 35 U.S.C. 154(b) by 0 days.

(21) Appl. No.: 10/119,860

(22) Filed: Apr. 11, 2002

(65) Prior Publication Data

US 2003/0038582 A1 Feb. 27, 2003

(30) Foreign Application Priority Data

Apr. 11, 2001 (JP) ..... 2001-113026

(51) Int. Cl.[7] ..... H01J 31/00; H01J 29/10

(52) U.S. Cl. ..... 313/477 R; 313/461; 313/478; 455/24

(58) Field of Search ..... 313/477 R, 461, 313/466, 478, 479, 402, 634; 445/24, 25; 220/2.1 A, 2.3 A; 348/821

(56) References Cited

U.S. PATENT DOCUMENTS

| | | | | |
|---|---|---|---|---|
| 4,904,899 | A | 2/1990 | Nakata et al. | |
| 5,445,285 | A | 8/1995 | Sugawara et al. | |
| 5,536,995 | A | 7/1996 | Sugawara et al. | |
| 5,837,026 | A | 11/1998 | Sugawara et al. | |
| 5,925,977 | A | 7/1999 | Sugawara et al. | |
| 5,964,364 | A | 10/1999 | Shimizu et al. | |
| RE36,838 | E | 8/2000 | Sugawara et al. | |
| 6,121,723 | A | 9/2000 | Sugawara et al. | |
| 6,236,151 | B1 | 5/2001 | Murakami et al. | |
| 6,353,283 | B1 * | 3/2002 | Ghosh et al. | 313/477 R |
| 2001/0049327 | A1 | 12/2001 | Hachitani | |

FOREIGN PATENT DOCUMENTS

| | | |
|---|---|---|
| GB | 2 221 083 | 1/1990 |
| JP | 57-208042 | 12/1982 |
| JP | 59-214141 | 12/1984 |
| JP | 2000-348643 | 12/2000 |
| JP | 2001-294442 | 10/2001 |
| JP | 2002-60242 | 2/2002 |

* cited by examiner

*Primary Examiner*—James Clinger
(74) *Attorney, Agent, or Firm*—Oblon, Spivak, McClelland, Maier & Neustadt, P.C.

(57) ABSTRACT

A glass bulb for a cathode ray tube comprising a panel portion having a substantially rectangular face portion and a funnel portion having a neck portion, wherein when the glass bulb is used for a cathode ray tube, the glass bulb at least regionally suffers from a tensile stress resulting from the atmospheric pressure on the outer surface of the glass bulb having a vacuum inside, at least part of the face portion of the panel portion where the tensile stress over the face portion has a maximum value $\sigma_{VP}$ has a compressive stress layer formed by chemical tempering on the outer surface, and the $\sigma_{VP}$, the magnitude of the compressive stress on the compressive stress layer $\sigma_C$ MPa, and the thickness of the compressive stress layer $t_C$ $\mu$m satisfy the following relationship:

$$120/t_C \geqq (1-|\sigma_{VP}/\sigma_C|) > 30/t_C$$

provided that $\sigma_{VP} \geqq 20$ MPa.

4 Claims, 3 Drawing Sheets

GLASS BULB FOR A CATHODE RAY TUBE AND CATHODE RAY TUBE

The present invention relates to a cathode ray tube mainly used for receiving TV broadcasts and a glass bulb for a cathode ray tube.

As is shown in FIG. 2, a cathode ray tube 1 primarily used for receiving TV broadcasts has an envelope basically formed by bonding a panel portion 3 as an image display and an almost funnel-shaped funnel portion 2 which comprises a neck portion 5 housing an electron gun 11, a yoke portion 6 for mounting a deflection coil and a body portion 4, along a sealing portion 10. The panel portion 3 consists of a skirt portion 8 to be joined with the funnel portion 2 and a face portion 7 as an image display. The panel portion 3 and the funnel portion 2 make up a glass bulb.

In FIG. 2, 12 denotes a phosphor layer which emits fluorescence upon irradiation with an electron beam, 14 denotes a shadow mask which defines the positions of the phosphors to be irradiated with an electron beam, and 13 denotes a stud pin to fix the shadow mask 14 to the inside of the skirt 8. A is the tube axis which leads the central axis of the neck portion 5 to the center of the panel portion 3. The face portion 7 of the panel portion 3 is a substantially rectangular area surrounded by four edges substantially parallel with the long and short axes which intersect at right angles on the tube axis A.

A cathode ray tube maintains a high vacuum in it to display images made of luminescence from phosphors excited by high speed electron bombardment. The difference between the internal and external pressures of the glass bulb acts as an external force to produce a vacuum stress on the aspherical and asymmetric glass bulb, and a great tensile stress, or a tensile vacuum stress, develops on the edges of the face portion of the panel portion, the outer surface of the skirt portion and the outer surface of the funnel portion near the sealing portion. The tensile vacuum stress is especially great at the ends of the short and long axes of the panel portion on the edges of the face portion (the ends of the axes of the face portions).

FIG. 3 shows a stress distribution along the short and long axes, and the solid line represents the vacuum stress in the paper plane, while the broken line represents the vacuum stress perpendicular to the paper plane. The numbers affixed to the stress distribution lines represent the magnitudes of the stress at the respective spots. FIG. 3 clearly shows that the tensile vacuum stress is generally great along the short axis, the panel portion has a maximum stress on the edges of the face portion, while the funnel portion has a great stress near the sealed edge of the body portion. A thinner glass bulb suffers a larger tensile vacuum stress and is more likely to mechanically fracture upon abrasion of these regions where the stress reaches a maximum.

A crack in a glass bulb for a cathode ray tube in such a state spreads to release the high internal deformation energy to fracture of the bulb. Besides, a glass bulb with a high tensile stress on the outer surface may be less reliable because delayed destruction can take place due to the action of the atmospheric moisture. Though a simple way to secure mechanical strength of a glass bulb is to increase the thickness of the glass bulb sufficiently, this ends up with an increase in weight to about 37 kg in the case of a glass bulb with a screen size of about 76 cm.

On the other hand, numerous image displaying devices other than the cathode ray tube have come into practical use in recent years. As compared with them, the great depth and weight of the cathode ray tube is pointed out as its big disadvantage as a displaying device. Therefore, there is strong pressure to reduce the depth or weight. However, reduction in the depth of a conventional cathode ray makes its structure more asymmetrical and therefore causes the problem of accumulation of more deformation energy in the glass bulb. Further, weight reduction usually leads to increase in deformation energy by making the glass less rigid, and the resulting higher deformation energy helps increase the risk of fracture and reduce reliability against delayed destruction by producing a large tensile stress. Increase of the glass thickness prevents the stress from increasing by lowering the deformation energy, but results in increase of weight, as described above.

As a conventional way to reduce a glass bulb for a cathode ray tube in weight, it is practical to form a compressive stress layer on the surface of the glass panel in ⅙ the thickness of the glass by physical tempering, as disclosed in U.S. Pat. No. 2,904,067. However, it is impossible to uniformly quench the panel portion and the funnel portion having three-dimensional structures and uneven thicknesses. Since a large residual tensile stress develops concurrently with the compressive stress due to the uneven temperature distribution, the compressive stress is limited to at most about 30 MPa, and it is impossible to produce a relatively large compressive stress. In summary, reduction of the weight of a glass bulb by physical tempering is limited because the resulting compressive stress is relatively small.

It is also known to reduce the weight of a glass bulb by chemically tempering its surface. In this method, specific alkali ions in the glass are replaced with larger ions at temperatures below the annealing temperature, and the resulting volume increase causes formation of a compressive stress layer on the surface. For example, strontium-barium-alkali-alumina-silicate glass containing from 5 to 8% of $Na_2O$ and from 5 to 9% of $K_2O$ is immersed in molten $KNO_3$ at about 450° C. Chemical tempering is advantageous over physical tempering in that it can provide a large compressive stress about from 90 MPa to 300 MPa without producing an undesirable tensile stress.

On the other hand, as compared with physical tempering, chemical tempering is disadvantageous in that because it usually provides a relatively thin compressive stress layer of about from 20 $\mu$m to 200 $\mu$m, which is about the same as the depth of abrasions made during manufacture of cathode ray tubes or on the market, a compressive stress layer having an insufficient thickness has little effect against abrasions having depths greater than its thickness. Formation of a sufficiently thick compressive stress layer requires that the glass be maintained at nearly annealing temperature for a long time and therefore has problems of deformation of the glass and of stress reduction due to stress relaxation. Further, it has been unclear how much the weight of a glass bulb can be reduced by chemical tempering in view of the magnitude of the stress and the thickness of the resulting compressive stress layer, while securing sufficient reliability, i.e., the limitation of weight reduction.

The object of the present invention is to solve the drawbacks of the conventional techniques for weight reduction of glass bulbs. Namely, in the above-mentioned conventional weight reduction of glass bulbs by chemical tempering, the thickness of the compressive stress layer formed by chemical tempering is determined simply from the depth of abrasions anticipated during manufacture of cathode ray tubes or on the market, and the influence of the tensile vacuum stress which develops on the glass bulb due to the difference between the internal and external pressures of the cathode ray tube on the compressive stress layer is not considered at all. Namely, the relationship between the tensile vacuum stress and the effective thickness of a compressive stress layer has not been sufficiently elucidated yet.

Therefore, no glass bulb with light weight which sufficiently resists abrasions anticipated during manufacture of cathode rays or on the market even under a tensile vacuum stress is available, and its realization is strongly demanded.

In view of the above-mentioned problems and object, the present invention provides a glass bulb which is enough reliable to sustain the difference between the internal and external pressures of a cathode ray tube, by determining the weight reduction of a glass bulb by chemical tempering from the relationship between the maximum tensile vacuum stress resulting from the difference between the internal and external pressures of a cathode ray tube which depends on the structure and the wall thickness of the glass bulb and the thickness of the compressive stress layer resulting from the chemical tempering and the magnitude of the compressive stress in the region where the maximum tensile vacuum stress occurs.

The present invention provides a glass bulb for a cathode ray tube comprising a panel portion having a substantially rectangular face portion and a funnel portion having a neck portion, wherein when the glass bulb is used for a cathode ray tube, the glass bulb at least regionally suffers from a tensile stress resulting from the atmospheric pressure on the outer surface of the glass bulb having a vacuum inside, at least part of the face portion of the panel portion where the tensile stress over the face portion has a maximum value $\sigma_{VP}$ has a compressive stress layer formed by chemical tempering on the outer surface, and the $\sigma_{VF}$, the magnitude of the compressive stress on the compressive stress layer $\sigma_C$ MPa, and the thickness of the compressive stress layer $t_C$ $\mu$m satisfy the following relationship:

$$120/t_C \geqq (1-|\sigma_{VP}/\sigma_C|) > 30/t_C$$

provided that $\sigma_{VP} \geqq 20$ MPa.

The present invention also provides a glass bulb for a cathode ray tube comprising a panel portion having a substantially rectangular face portion and a funnel portion having a neck portion, wherein when the glass bulb is used for a cathode ray tube, the glass bulb at least regionally suffers from a tensile stress resulting from the atmospheric pressure on the outer surface of the glass bulb having a vacuum inside, at least part of the funnel portion where the tensile stress over the funnel portion has a maximum value $\sigma_{VF}$ has a compressive stress layer formed by chemical tempering on the outer surface, and the an, the magnitude of the compressive stress on the compressive stress layer $\sigma_C$ MPa, and the thickness of the compressive stress layer $t_C$ $\mu$m satisfy the following is relationship;

$$120/t_C \geqq (1-|\sigma_{VF}/\sigma_C|) > 30/t_C$$

provided that $\sigma_{VF} \geqq 10$ MPa.

The present invention further provides a cathode ray tube using the glass bulb for a cathode ray tube.

FIG. 1 explains the relationship between the stress on the compressive stress layer formed by chemical tempering, the thickness of the compressive stress layer and the tensile vacuum stress.

Figure 1:
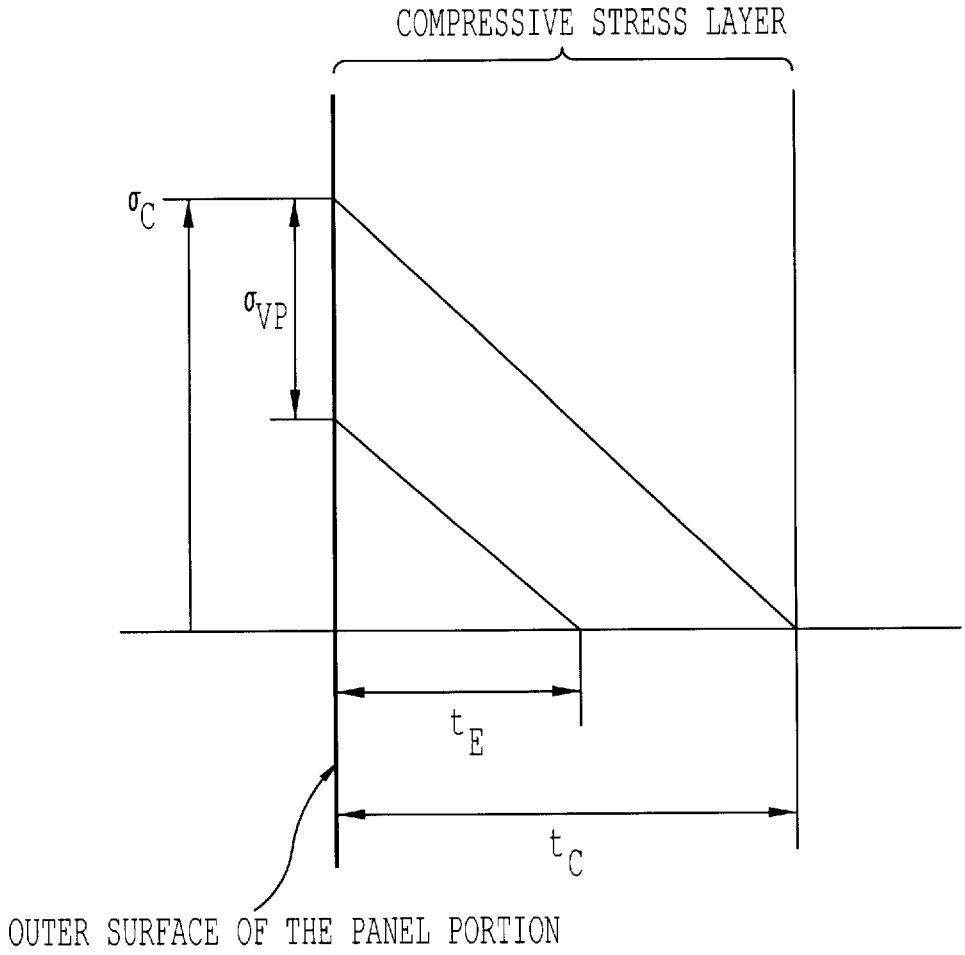
Figure 2:
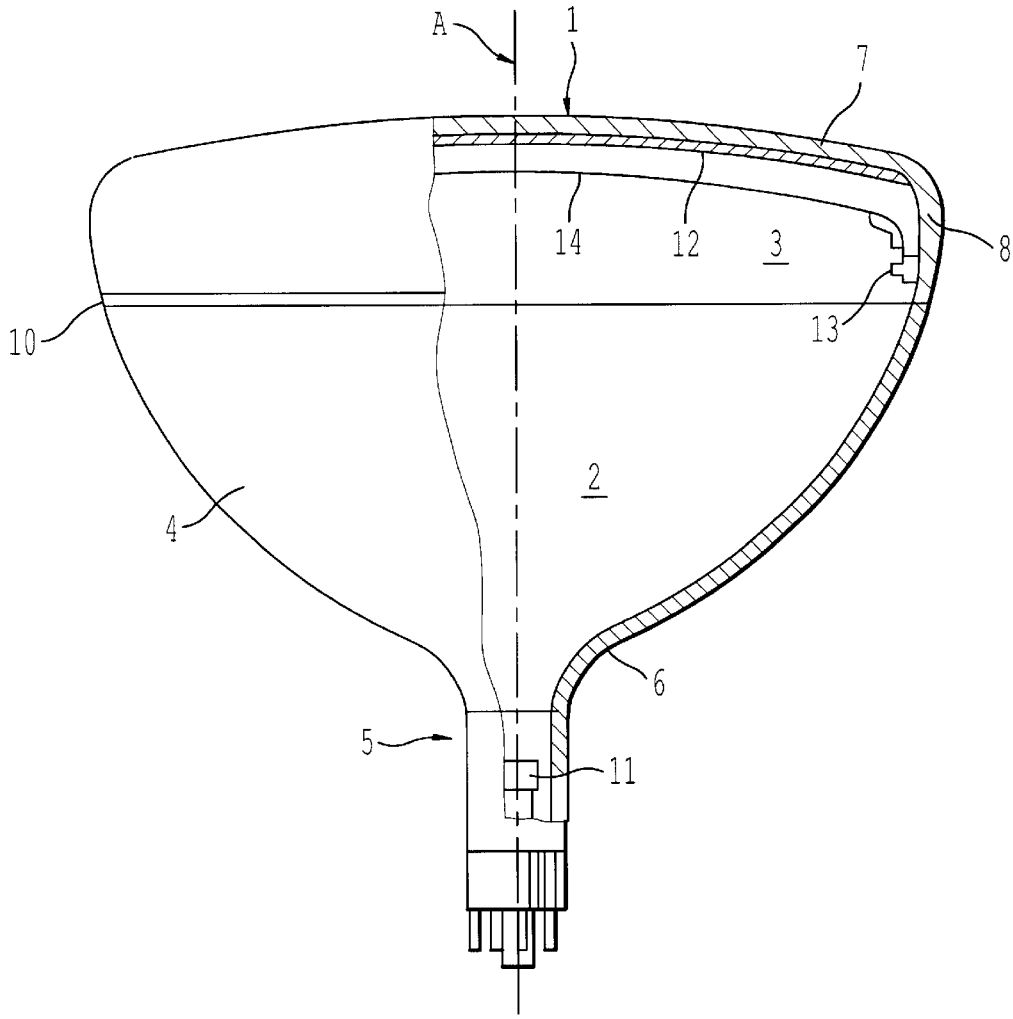
FIG. 2 is a partially cross-sectional front view of a cathode ray tube.
Figure 3:
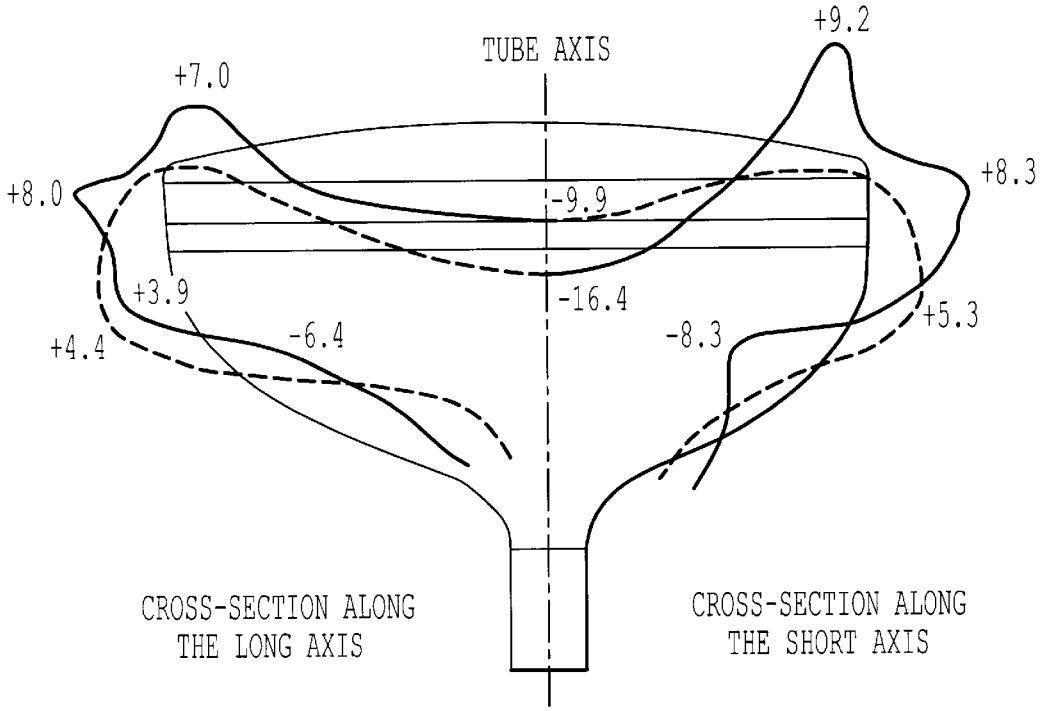
FIG. 3 shows a vacuum stress distribution over a glass bulb.

As described above, the present invention provides a glass bulb with secured reliability and sufficiently light weight by determining the weight reduction of a glass bulb by chemical tempering from the relationship between the maximum tensile vacuum stress which depends on the structure and the wall thickness of the glass bulb and the thickness of the compressive stress layer resulting from the chemical tempering and the magnitude of the compressive stress.

In general, the thickness $t_C$ (hereinafter expressed in $\mu$m) of a compressive stress layer formed in glass by ion exchange is the depth of the point where the surface concentration of ions of a particular alkali such as potassium and the concentration of the same ions inherent in the glass almost attain equilibrium. The compressive stress in the compressive stress layer changes from the maximum value $\sigma_C$ at the surface to zero at the depth of $t_C$. The compressive stress change with depth is proportional to the change in the concentration of the alkali ions.

Meanwhile, the depth of abrasion made on the surface of a cathode ray tube during ordinary is known to be at most 30 $\mu$m, which is about the same as the depth of abrasion with an emery sheet #150, as shown in Table 1. If there is no difference between the internal and external pressures of the cathode ray tube, chemical tempering which forms a compressive stress layer deeper than such abrasion can impart sufficient strength.

TABLE 1

| Abrading tool | Average depth ($\mu$m) | Maximum depth ($\mu$m) |
|---|---|---|
| Emery sheet #400 | 10 | 12 |
| Emery sheet #150 | 21 | 30 |
| Cutter knife | 30 | 56 |
| Diamond cutter | 115 | 140 |

However, since there is difference between the internal and external pressures of a cathode ray during ordinary use, a compressive stress layer a little thicker than the depth of such abrasion can not withstand such abrasion because the effective thickness of the compressive stress layer is smaller than the actual one due to the tensile stress resulting from the difference between the internal and external pressures. Therefore, it is even possible that conventional reduction of tensile stress by thickening the wall of a glass bulb has no strengthening effect at all, without mentioning that sufficient weight reduction is not achieved.

Now, the influence of the tensile vacuum stress on the compressive stress layer will be explained. As described above, because different internal and external pressures are applied to the aspherical and asymmetric structure, a large tensile vacuum stress occur over a relatively large region of the outer surface of the glass bulb along its long and short axes. For example, the tensile vacuum stress of the panel portion has the maximum value $\sigma_{VP}$ on the edges of the face portions, and the tensile vacuum stress of the funnel portion has the maximum value $\sigma_{VF}$ on the sealing edge of the body portion. The maximum tensile vacuum stress $\sigma_{VP}$ of the panel portion and the maximum tensile vacuum stress $\sigma_{VF}$ of the funnel portion depend on the shape of the glass bulb and the wall thickness of the glass and increases as the wall thickness is decreased to reduce the weight.

The in-depth vacuum stress distribution is almost linear where the tensile vacuum stress of the panel portion has the maximum value $\sigma_{VP}$, because of the bending deformation attributable to the pressure difference. The vacuum stress is approximately zero at the depth of half the thickness, and the compressive stress on the inner surface is about the same in magnitude as the tensile stress on the outer surface. For example, in the region of the face portion of a cathode ray tube having an effective screen area with an aspect ratio of 1:6 and a maximal diameter of 86 cm where the face portion has $\sigma_{VP}$, the wall thickness is as large as 11 mm (Table 2) while the thickness $t_C$ of the compressive stress layer formed by chemical tempering is very small. Therefore, the loss of the tensile vacuum stress on the compressive stress layer is small, and the tensile strength can be approximated to a constant value $\sigma_{VP}$.

Accordingly, near the surface of such region of the face portion, because both the compressive stress resulting from chemical tempering and the vacuum stress $\sigma_{VP}$ are present, the effective compressive stress is obtained by subtracting $\sigma_{VP}$. FIG. 1 shows the effective thickness $\sigma_E$ of a compressive stress layer with a stress value $\sigma_C$ and a thickness $t_C$ formed by chemical tempering on the surface of the region of the face portion where the tensile vacuum stress $\sigma_{VP}$ is present. The in-depth distribution of $\sigma_C$ is almost linear though it varies depending on the time of the chemical tempering, the humidity during the chemical tempering, the composition of the glass, the melt used for the chemical tempering and the like.

Consequently, the decrease in the effective thickness $t_E$ ($\mu$m) of the compressive stress layer is supposed to follow the relationship represented by $t_E=(1-|\sigma_{VP}/\sigma_C|)t_C$. Namely, in a cathode ray tube having such a structure as induces $\sigma_{VP}$, the effective thickness of a compressive stress layer decreases to $t_E$ from $t_C$ due to the bending deformation attributable to $\sigma_{VP}$. The decrease depends on $\sigma_{VP}$ and $\sigma_C$.

As a result, even if the compressive stress layer formed by chemical tempering is enough thick to withstand abrasion with anticipated depth under no vacuum stress, it may not hold under a vacuum stress. For example, the effective thickness of a compressive stress layer in the panel portion under a vacuum stress $\sigma_{VP}$ of at least 20 MPa has to be at least 30 $\mu$m. With respect to the funnel portion, the $\sigma_P$ is 10 MPa or more in view of its structure, and the effective thickness of a compressive stress layer has to be at least 30 $\mu$m as in the panel portion. If the effective thickness of the compressive stress layer is less than 30 $\mu$m, the compressive stress layer is not deep enough for anticipated abrasion and lacks sufficient strength and reliability. In other words, for weight reduction by chemical tempering which gives a compressive stress layer having a thickness of $t_C$, the panel has to have such a structure that $\sigma_{VP}$ satisfies $$(1-|\sigma_{VP}/\sigma_C|)>30/t_C.$$

On the other hand, chemical tempering which gives $t_C$, larger than 120 $\mu$m is not preferable, though preferable in view of strength, because it requires a long time of ion exchange at approximately annealing temperature at which the glass bulb undergoes viscous deformation.

The above explanation about the region of the panel portion where the tensile vacuum stress has a maximum value $\sigma_{VP}$, applies to the influence of tensile vacuum stress on a compressive stress layer formed by chemical tempering in a region of the funnel portion where the tensile vacuum stress has a maximum value $\sigma_p$. Therefore, an explanation for the funnel portion is omitted.

In the present invention, the $\sigma_{vp}$, has to be at least 20 MPa. If $\sigma_{VP}$ is less than 20 MPa, the glass bulb is so rigid that the vacuum deformation is slight. This means that the glass wall thickness of the panel portion is large, and significant weight reduction can be attained. Beside, since the influence of $\sigma_{VP}$ on the compressive stress layer formed by chemical tempering is naturally subtle, the influence of $\sigma_{VP}$ is substantially negligible. Therefore, it is necessary that $\sigma_{VP}$ is at least 20 MPa.

In contrast, $\sigma_{VP}$ may be at least at least 10 MPa, because the funnel portion is structurally different from the panel portion. If $\sigma_{VF}$ is less than 10 MPa, the funnel portion has a thick glass wall like the panel portion, and weight reduction can not be attained.

The present invention further defines the effective thickness of a compressive stress layer formed by chemical tempering under the maximum tensile vacuum stresses $\sigma_{VP}$ and $\sigma_{VF}$ at least in regions of a glass bulb where the tensile vacuum stress has the maximum value $\sigma_{VP}$ or $\sigma_{VF}$. The reason is that when a cathode ray tube suffer from an external force or abrasion, the glass bulb is likely to fracture from such regions. With respect to the other regions where neither $\sigma_{VP}$ nor $\sigma_{VF}$ occur, the effective thickness may be determined on the basis of that in such regions. The regions of the panel portion and the funnel portion wherein $\sigma_{VP}$ and $\sigma_{VF}$ occur vary depending on the shape and the wall thickness of the glass bulb. In the panel portion, they are the ends of the short and long axes of the face portion, and in the funnel portion, they are usually the vicinity of the ends of the short and long axes on the sealed edge of the body portion.

In the chemical tempering of a glass bulb in the present invention, the whole or main parts of the glass bulb covering the regions where $\sigma_{VP}$ or $\sigma_{VF}$ occurs is usually subjected to the chemical tempering. In addition, in chemical tempering by immersion of a glass bulb, the effect of chemical tempering is uniform over the immersed portion of the glass bulb. Therefore, if chemical tempering is carried out so that the regions where $\sigma_{VP}$ and $\sigma_{VF}$ occur are strong enough, the strength of the other regions. Though either or both of the panel portion and the funnel portion may be subjected to chemical tempering, it is practical to subject only the panel portion which shows greater effect of chemical tempering.

Further, in chemical tempering of a glass bulb, though chemical tempering of only the outer surface of the glass bulb usually produces sufficient effect, the inner surface may be tempered, of course. Further, it is possible to subject only the face portion, not the whole of the panel portion to chemical tempering. Among the funnel portion, tempering of only the body portion usually produces sufficient effect.

The present invention makes it possible to manufacture cathode ray tubes conventionally by using the panel portion and the funnel portion and reduce the weight of a cathode ray tube to a minimum while securing safety.

EXAMPLES

Five kinds of panel portions having an aspect ratio of 16:9, different wall thicknesses, effective screens on the face portion with diagonal sizes of 860 mm, curvature radii of the outer surface of the face portion of 100000 mm and total panel heights of 120 mm, were prepared, and the panel portions and funnel portions having deflection angles of 103° were assembled into glass bulbs and designated as Examples and Comparative Examples. All the glass materials used had been manufactured by Asahi Glass Company, and panel portions with a product code: 5008 and funnel portions with a product code; 0138 were used.

Then, the panel portions of Example 1, Example 2, Comparative Example 2 and Comparative Example 3, and the funnel portions of Example 3, Comparative Example 5 and Comparative Example 8 were immersed in molten $KNO_3$ at 450° C. for various periods of time to be tempered through ion exchange to form compressive stress layers having different thicknesses on the surfaces. These glass bulbs were evacuated, and their entire surfaces were abraded with an emery sheet #150, and the other glass bulbs were abraded with an emery sheet *150 after evacuation. These glass bulbs were subjected to differences between external and internal pressures, and their strengths were compared. In each of Examples and Comparative Examples, 25 glass bulbs were tested.

The average allowable pressure of the tested 25 bulbs and the smallest of the differences between the internal and external pressures to fracture of the 25 specimens was designated as a minimum allowable pressure, and the minimum allowable pressures were compared to evaluate penetration of a crack into a compressive stress layer. If a crack formed by abrasion penetrates through a compressive stress layer, the strength decreases remarkably, and therefore the difference between the internal and external pressure is naturally small. On the other hand, if a crack does not penetrate, the difference between the internal and external pressures is comparable to or larger than that of a conventional glass bulb which has not been subjected to chemical tempering. Each Example and Comparative Example is explained below.

The method for measuring the compressive stress and tensile stress used in the present invention is explained below. One approach for measuring compressive stress on glass is to use the proportionality between the difference in the principal stress produced by application of a force on the glass and the difference in refractive index in the direction of the principal stress. As linearly polarized light passes glass under stress, the transmitted light splits into component waves with different velocities in the direction of the principal stress which are polarized in planes which make a right angle. One of the transmitted component waves is slower than the other, and the refractive index of the glass varies in the direction of the principal stress, depending on the velocities of the component waves. Since the difference in the stress on the glass is proportional to the difference in refractive index, namely double refraction, the stress on the glass can be determined from the phase difference between the component waves.

The polarization microscope utilizes this principle, and casts light on a cross section of glass under residual stress and measures the phase difference between the transmitted components vibrating in the direction of the principal stress to determine stress. For the measurement, a polarizer is placed in front of the glass, and a plate having a phase difference and an analyzer which detect the polarized light are provided behind the glass. As plates having phase differences, for example, a Berek compensator, a Babinet compensator and a quarter-wave plate may be mentioned. The phase difference in the region to be measured is adjusted to zero with these devices so that a dark line appears, and the stress value is obtained from the amount of the adjustment with the compensator.

Further, instead of these various compensators, a tint plate which has an optical-path difference around 565 nm and varies the interference color by reacting even a slight change in the optical-path difference may used. It shows an interference color which changes with the phase difference resulting from slight double refraction of the light transmitted through glass and makes it possible to determine the level of stress by color. By using this property, a cross section of the glass is observed, and the thickness of the stress layer was measured.

Further, the allowable pressure was measured as follows. Prior to measurement, a circular abrasion was made on the outer surface of a glass bulb with an emery sheet #150 with a constant force. Within 30 minutes of the abrasion, it was examined in a pressurized container filled with water at room temperature. Before the glass bulb was put in the pressurized container, the glass bulb was filled with water with the neck portion faced upward. Then, one end of a rubber hose was connected to the neck portion, and the other end was pulled out of the pressurized container to keep the inside of the glass bulb at atmospheric pressure. The glass bulb was sunk so that the end of the neck came under the water with the neck faced upward, and the pressurized container was closed. The glass bulb was sunk 10 minutes prior to pressurization for equilibration between the temperatures of the glass bulb and the water. Then, pressure was applied at a pressurization rate of about 0.4 MPa per minute until the bulb broke. The apparatus could control pressure with a precision of 0.001 MPa. By the above-mentioned procedure, a difference between the internal and external pressures of the glass bulb was developed, and the pressure difference was measured with a pressure gauge attached to the pressurized container. The allowable pressure of a bulb was defined as the pressure difference at break.

Example 1

In the present Example, the panel portion of a glass bulb was focused, and the inside of a glass bulb was subjected to chemical tempering so that the thickness $t_E$ of the resulting compressive stress layer would be 35 $\mu$m when the glass bulb was evacuated to the same degree as a cathode ray tube. The results of the present Example as well as of a Comparative Example are shown in Table 2. The weight was 35% lighter than that of Comparative Example 1 having a conventional design without chemical tempering.

Not only the average allowable pressure but also the minimum allowable pressure was comparable to that of the conventional ones. This indicates that the glass bulbs were fully guaranteed against abrasion deeper than the compressive stress layer formed by chemical tempering.

Example 2

In the present Example, the conditions for chemical tempering were changed from those employed in Example 1. Despite of increase in $\sigma_{VP}$ resulting from weight reduction, high reliability and weight reduction of 37% were attained.

Example 3

In the present Example, the funnel portion was focused, and the inside of a glass bulb was subjected to chemical tempering so that the thickness $t_E$ of the resulting compressive stress layer would be 31 $\mu$m when the glass bulb was evacuated to the same degree as a cathode ray tube. The results of the present Example as well as of a Comparative Example are shown in Table 3. The weight was 12% lighter than that of Comparative Example 4 having a conventional design without chemical tempering.

Not only the average allowable pressure but also the minimum allowable pressure was much higher than that of the conventional ones. This indicates that the glass bulbs were fully guaranteed against abrasion deeper than the compressive stress layer formed by chemical tempering.

Comparative Example 1

Panel portions having a conventional design without chemical tempering.

Comparative Example 2

Panel portions with the same shape as in Example 1 wherein the thickness of the compressive stress layer formed by chemical tempering was insufficient to give sufficient $t_E$. Because of the $t_E$ as small as 20 $\mu$m, a crack penetrated through the compressive stress layer in the presence of a difference between internal and external pressures though the compressive stress $\sigma_C$ produced by chemical tempering was the same as in Example 1. Most of them fractured under a small difference between the internal and external pressures, and not only the average allowable pressure was lower than that in Example 1 but also the minimum allowable pressure was below the ordinary service pressure 0.1 MPa. Thus, they were practically unusable.

Comparative Example 3

Panel portions designed so that $t_E$ would be 34 $\mu$m after the same chemical tempering as in Comparative Example 2 at $\sigma_{VP}$ of 18 MPa. Because the wall thicknesses were increased to lower $\sigma_{VP}$, chemical tempering had little effect, and the weight could not be reduced sufficiently.

Comparative Example 4

Funnel portions having a conventional design without chemical tempering.

Comparative Example 5

Funnel portions with the same shape as in Example 3 wherein the thickness of the compressive stress layer formed by chemical tempering was insufficient to give sufficient $t_E$. Because of the $t_E$ as small as 23 $\mu$m, a crack penetrated through the compressive stress layer though the compressive stress $\sigma_C$ produced by chemical tempering of the funnel portions was the same as in Example 3. The results were similar to those obtained in Example 2. Thus, they were practically unusable.

Comparative Example 6

Funnel portions designed so that $t_E$ would be 35 $\mu$m after the same chemical tempering as in Comparative Example 5 at $\sigma_{VP}$ of 8 MPa. Because the wall thicknesses were increased to lower $\sigma_{VP}$, chemical tempering had little effect, and the weight could not be reduced sufficiently.

TABLE 2

| | Ex. 1 | Ex. 2 | Comp. Ex. 1 | Comp. Ex. 2 | Comp. Ex. 3 |
|---|---|---|---|---|---|
| Wall thickness at the center of panel face (mm) | 10.5 | 10.0 | 21.0 | 10.5 | 17.0 |
| Wall thickness (mm) at $\sigma_{VP}$ point | 11.0 | 10.5 | 21.5 | 11.0 | 17.5 |
| $\sigma_{VP}$ (MPa) | 60 | 70 | 9 | 60 | 18 |
| Chemical tempering | Done | Done | Not done | Done | Done |
| $\sigma_C$ (MPa) | 120 | 100 | 0 | 120 | 120 |
| $T_C$ ($\mu$m) | 70 | 160 | 0 | 40 | 40 |
| $T_E$ ($\mu$m) | 35 | 48 | 0 | 20 | 34 |
| Average allowable pressure (MPa) | 0.32 | 0.27 | 0.29 | 0.19 | At least 1.0 |
| Minimum allowable pressure (MPa) | 0.25 | 0.23 | 0.26 | 0.09 | 0.82 |
| Weight of panel portion (kg) | 24.2 | 23.6 | 37.2 | 24.2 | 32.3 |

TABLE 3

| | Ex. 3 | Comp. Ex. 4 | Comp. Ex. 5 | Comp. Ex. 6 |
|---|---|---|---|---|
| Wall thickness (mm) at $\sigma_{VP}$ point | 7.0 | 13.0 | 7.0 | 12.5 |
| $\sigma_{VP}$ (MPa) | 15 | 9 | 15 | 8 |
| Chemical tempering | Done | Not done | Done | Done |
| $\sigma_C$ (MPa) | 70 | 0 | 70 | 70 |
| $T_C$ ($\mu$m) | 40 | 0 | 35 | 40 |

TABLE 3-continued

| | Ex. 3 | Comp. Ex. 4 | Comp. Ex. 5 | Comp. Ex. 6 |
|---|---|---|---|---|
| $T_E$ ($\mu$m) | 31 | 0 | 23 | 35 |
| Average allowable pressure (MPa) | 0.98 | 0.29 | 0.26 | At least 1.0 |
| Minimum allowable pressure (MPa) | 0.46 | 0.26 | 0.08 | 0.86 |
| Weight of funnel portion (kg) | 15.0 | 17.0 | 15.0 | 16.5 |

As discussed above, the present invention provides a glass bulb which is light in weight and safe against abrasion, by determining the compressive stress layer formed in the glass bulb by chemical tempering by taking into consideration optimization of the tensile vacuum stress resulting from the difference between the internal and external pressures on the outer surface of a cathode ray tube made from the glass bulb and the influence of the vacuum stress.

Namely, the glass bulb does not fracture because the thickness of the compressive stress layer formed by chemical tempering is so determined that a crack made by ordinary abrasion does not penetrate into the compressive stress layer even if the glass bulb is under deformation stress resulting from the tensile vacuum stress while the allowable pressure of the thin-walled glass bulb having a relative large tensile vacuum stress is improved by chemical tempering. Because the optimization of the thickness of the compressive stress layer is based on the relationship between the tensile vacuum stress and the stress on the compressive stress layer, weight reduction of a glass bulb can be achieved while safety is secured.

The entire disclosure of Japanese Patent Application No. 2001-113026 filed on Apr. 11, 2001 including specification, claims, drawings and summary are incorporated herein by reference in its entirety.

What is claimed is:

1. A glass bulb for a cathode ray tube comprising a panel portion having a substantially rectangular face portion and a funnel portion having a neck portion, wherein when the glass bulb is used for a cathode ray tube, the glass bulb at least regionally suffers from a tensile stress resulting from the atmospheric pressure on the outer surface of the glass bulb having a vacuum inside, at least part of the face portion of the panel portion where the tensile stress over the face portion has a maximum value $\sigma_{VP}$ has a compressive stress layer formed by chemical tempering on the outer surface, and the $\sigma_{VP}$, the magnitude of the compressive stress on the compressive stress layer as $\sigma_C$ MPa, and the thickness of the compressive stress layer $t_C$ $\mu$m satisfy the following relationship:

$$120/t_C \geqq (1-|\sigma_{VP}/\sigma_C|) > 30/t_C$$

provided that $\sigma_{VP} \geqq 20$ MPa.

2. A glass bulb for a cathode ray tube comprising a panel portion having a substantially rectangular face portion and a funnel portion having a neck portion, wherein when the glass bulb is used for a cathode ray tube, the glass bulb at least regionally suffers from a tensile stress resulting from the atmospheric pressure on the outer surface of the glass bulb having a vacuum inside, at least part of the funnel portion where the tensile stress over the funnel portion has a maximum value $\sigma_{VF}$ has a compressive stress layer formed by chemical tempering on the outer surface, and the $\sigma_{VF}$, the magnitude of the compressive stress on the compressive stress layer $\sigma_C$ MPa, and the thickness of the compressive stress layer $t_C$ $\mu$m satisfy the following relationship:

$$120/t_C \geqq (1|\sigma_{VF}/\sigma_C|) > 30/t_C$$

provided that $\sigma_{VF} \geqq 10$ MPa.

3. The glass bulb for a cathode ray tube according to claim 1, wherein the compressive stress layer is formed by chemical tempering at least over the outer surface and the inner surface of the face portion of the panel portion and the outer surface and inner surface of the body portion of the funnel.

4. A cathode ray tube using the glass bulb for a cathode ray tube as defined in claim 1.

* * * * *